US005152701A

United States Patent [19]

Polidori

[11] Patent Number: 5,152,701

[45] Date of Patent: Oct. 6, 1992

[54] GRID CONNECTOR

[76] Inventor: Mario Polidori, P.O. Box 534, Pennsauken, N.J. 08110

[21] Appl. No.: 735,265

[22] Filed: Jul. 24, 1991

[51] Int. Cl.[5] ..... H01R 11/03

[52] U.S. Cl. ..... 439/791; 403/396; 403/399; 439/803

[58] Field of Search ..... 439/784, 790, 791, 803, 439/807, 811, 863; 403/395, 396, 398, 340

[56] References Cited

U.S. PATENT DOCUMENTS 4,911,572 3/1990 Williams ..... 439/791

FOREIGN PATENT DOCUMENTS 0563909 9/1944 United Kingdom ..... 439/791

*Primary Examiner*—Paula A. Bradley
*Attorney, Agent, or Firm*—Norman E. Lehrer

[57] ABSTRACT

A connecting device for electrically and mechanically joining two conductors positioned substantially perpendicular having improvements allowing for easier and safer installation. The connector includes a C-shaped body member and a wedge assembly. The C-shaped body member has two spaced apart fingers hooked to engage one conductor and a yoke section which joins the fingers and is contoured to engage another conductor. The wedge assembly provides the separating and securing means to the conductors and is comprised of two parts. The wedge assembly is comprised of a wedge shaped section and a T-shaped section that are mechanically engaged by use of interacting parts involving the incline of the wedge and the vertical portion of the "T". Each member of the wedge assembly has an independent contoured surface which engages one of the transversing conductors. The wedge assembly functions separately from and unconnected to the body member when installed between the conductors. The T-shaped member and wedge-shaped member are dependently connected via a bolt which upon tightening causes relative motion between the members up and along the wedge incline until a rigid and locked position is established.

13 Claims, 3 Drawing Sheets

GRID CONNECTOR

BACKGROUND OF THE INVENTION

This invention relates to electrical connectors and more particularly to an improved connector for joining two conductors extending transversely to one another at different levels and which cross one another defining a node point.

Grounding grids are used in electrical power installations where large amounts of electrical current are used or distributed, including utility generating stations and substations, and heavy industrial installations, such as refineries, chemical plants and steel mills. Grounding grids function to quickly and effectively dissipate surges of fault current so as to limit the potential damage of equipment and protect personnel close to the equipment.

Grounding grids consist of a matrix or crossover network of unjacketed, standard copper cable conductors buried underground or embedded in concrete and connected to above ground equipment by copper-clad steel. At each cross-over point of the conductors or node of the matrix, a connection has to be made that is mechanically and electrically sound and reliable.

The present invention is an improvement of the connector disclosed in U.S. Pat. No. 4,114,977 shown in FIG. 1. The prior art discloses an invention consisting of a connector, shown in FIG. 1, for joining two conductors extending transversely to one another comprising a body member 100, a nesting member 102 for positioning the two conductors within the body member, and a movable wedge member 104 for wedging the conductors in nested relation within the body member.

The body member 100 is generally C-shaped and includes a pair of fingers 110 and 111 openly spaced apart at one end for straddling a first conductor 114. At the openly spaced apart end, the fingers are curved or otherwise shaped to form hook-like seating surfaces for grasping the second conductor 116 extending transversely of the first conductor 114. The fingers 110 and 111 are joined at the other end by a yoke section 118.

The nesting member 102 is formed with two oppositely facing seating surfaces or depressions 106 and 120 extending transversely to one another and adapted to be positioned between the two conductors so that the conductors nest in the seating surfaces.

The wedge member 104 is mounted to the yoke section 118 so that it can wedge into the space between the yoke section and the first conductor 114. The lower surface of the wedge member 108 is formed with a seating surface or depression to fit over the first conductor 114.

The wedge member 104 is driven by a bolt means 124 coupled to the yoke section so that the conductors are secured in their seats in nested relation between the wedge member 104 and the hook-like ends of the fingers 110 and 111.

Problems with the aforementioned prior art include difficult installation and potentially one time usage. The wedge member 104 and nesting member 102 are independent parts whereby the wedge 104 is attached to the body member 100 and the nesting member 102 is separated from it by a conductor. This results in cumbersome installation and removal of the locking mechanism. The installer must hold the nesting member 102 in place while tightening the bolt 124. A similarly cumbersome step involves reaching underneath one conductor 114 and in between both conductors 114 and 116 to hold the nesting member 102 in place. This operation can result in dropped parts and damaged fingers.

Another problem with the prior art is the potential inability to reuse the connector because it is attached by a bolt 124 to the body member 100. If damage sustains to the wedge member 104, such damage could easily transfer via the bolt 124 to the threaded hole 119 of the body member 100, making both parts unsalvageable and causing increased cost.

SUMMARY OF THE INVENTION

The invention of the present application is an improvement over the prior art, single wedge type grid wire connector, in a manner to allow safer and easier installation of a connector for connecting substantially perpendicularly transversing conductors.

In accordance with the invention, the C-shaped body member has a yoke that joins hooked and contoured fingers. The yoke has a contoured groove along its length and across the center of the area between the fingers, facing the open end. The contoured groove allows for engagement of a conductor and helps to eliminate the joining of the locking device with the body member.

Similarly, the method for securing the conductors in place comprises a wedge assembly which includes a wedge-shaped member and a T-shaped member. Each member has a contoured surface to engage one of the conductors. The members are mechanically engaged by interacting parts and move relative to each other along the wedge incline via a torque, and separating force, limiting bolt. Upon tightening, the T-shaped member moves up the incline and into a conductor which fits into the contoured surface of the horizontal section of the "T".

Simultaneously, the horizontal edge and contoured surface of the wedge member move into the other conductor. The relative motion continues until the required separating force is reached and the limiting, hexagonal head shears off. The result is a rigid electrical and mechanical connection whereby only one part need by positioned and adjusted during installation or removal.

The instant invention allows for easier installation or removal of the connector. The installer need only place the wedge assembly between the conductors and tighten the bolt. There is no other independent part to be concerned with or any need to reach under or in between any conductors. The locking device can be installed and removed safely in a less cumbersome fashion.

Similarly, because the instant invention has an independent locking mechanism, the body member is always salvageable. The locking device, should it become damaged, can be removed and replaced with a new assembly completely independent of the body member.

DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
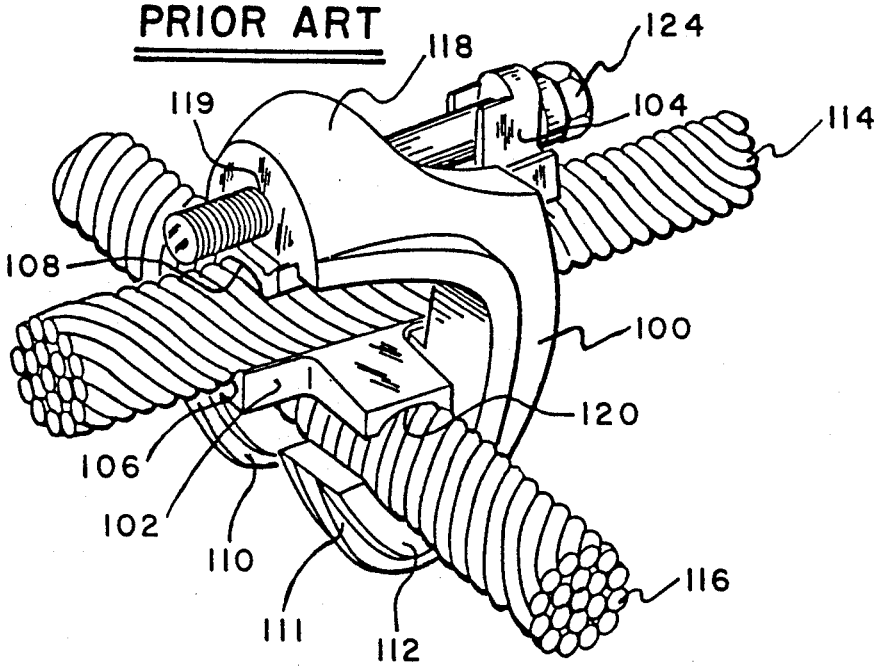
Fig. 1 PRIOR ART
FIG. 1 is a perspective view showing a connector of the prior art in its installed position.
Figure 2:
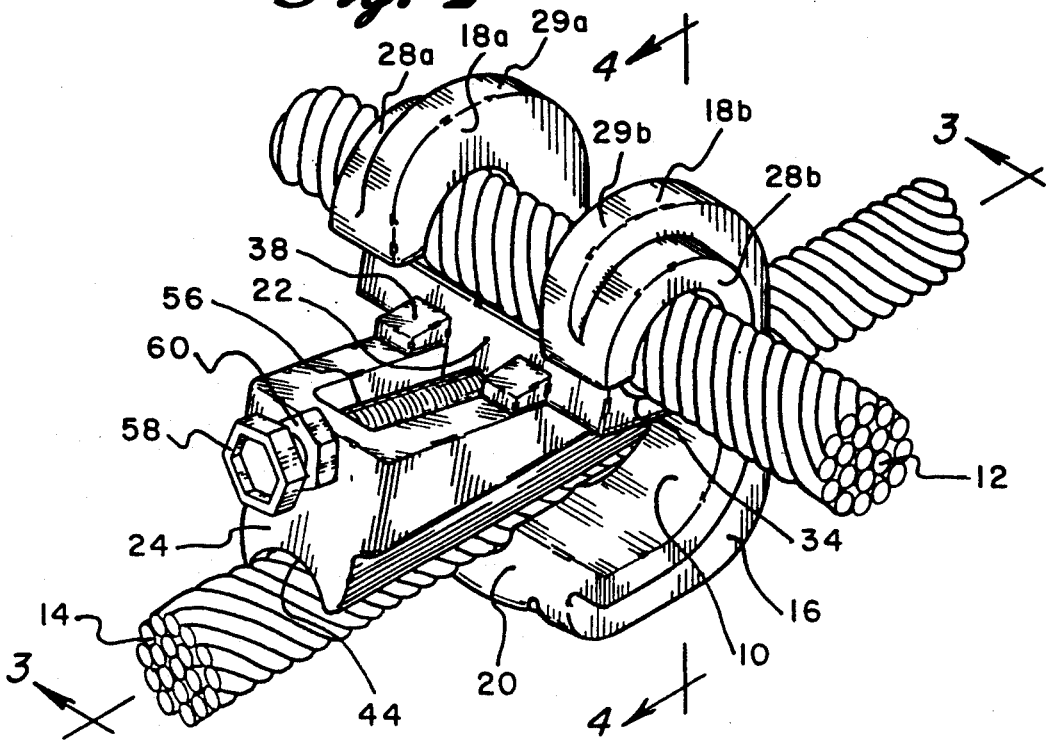
FIG. 2 is a perspective view of a connector constructed according to the principles of the present invention and installed at a node point on a transversing pair of conductors.

Referring now to the drawings in detail wherein like reference numerals have been used throughout the various figures to designate like elements, there is shown in FIG. 2 a perspective view of the conductor connector 10 installed at a node point where two conductors cross approximately perpendicularly. There is a first conductor 12 and a second conductor 14 mechanically and electrically connected by the connector 10.

Figure 6:
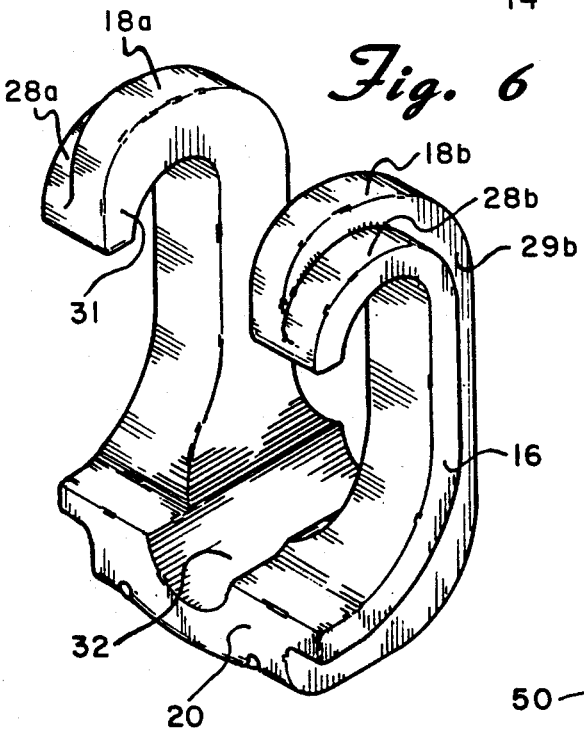
FIG. 6 is a perspective view of the body member.

The connector 10, comprises a substantially C-shaped body member 16 having two spaced fingers 18*a* and 18*b* each finger having a hook such as shown at 31 contoured on its inner surface which engages the first conductor 12. The fingers 18*a* and 18*b* are joined at the opposite end by a yoke section 20, as shown in FIG. 6, which is contoured for its length 32 and down its center on the surface facing the open space 19 between the fingers 18*a* and 18*b*. The contoured surface 32 of the yoke engages the second conductor 14.

Referring again to FIG. 2, the wedge-shaped assembly 26 engages each conductor on contoured surfaces 34 and 44 as it applies a separating force between conductors 12 and 14. The wedge assembly 26, shown most clearly in FIG. 7, comprises a wedge-shaped member 24 and a T-shaped member 22 which are dependently attached and move relative to each other by way of the adjusting bolt 56.

Figure 3:
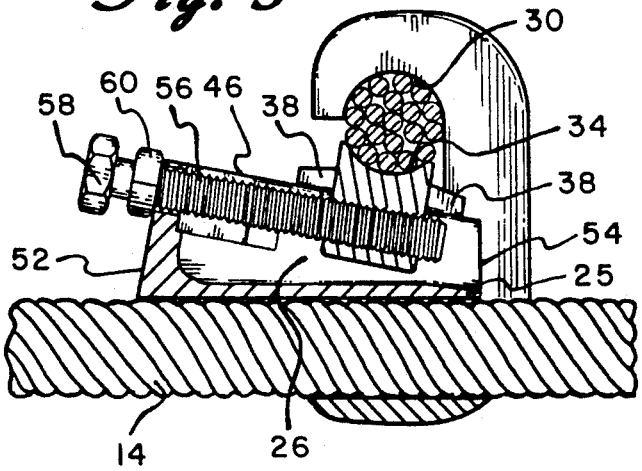
FIG. 3 is a cross-sectional view taken along the line 3—3 of FIG. 2.
Figure 7:
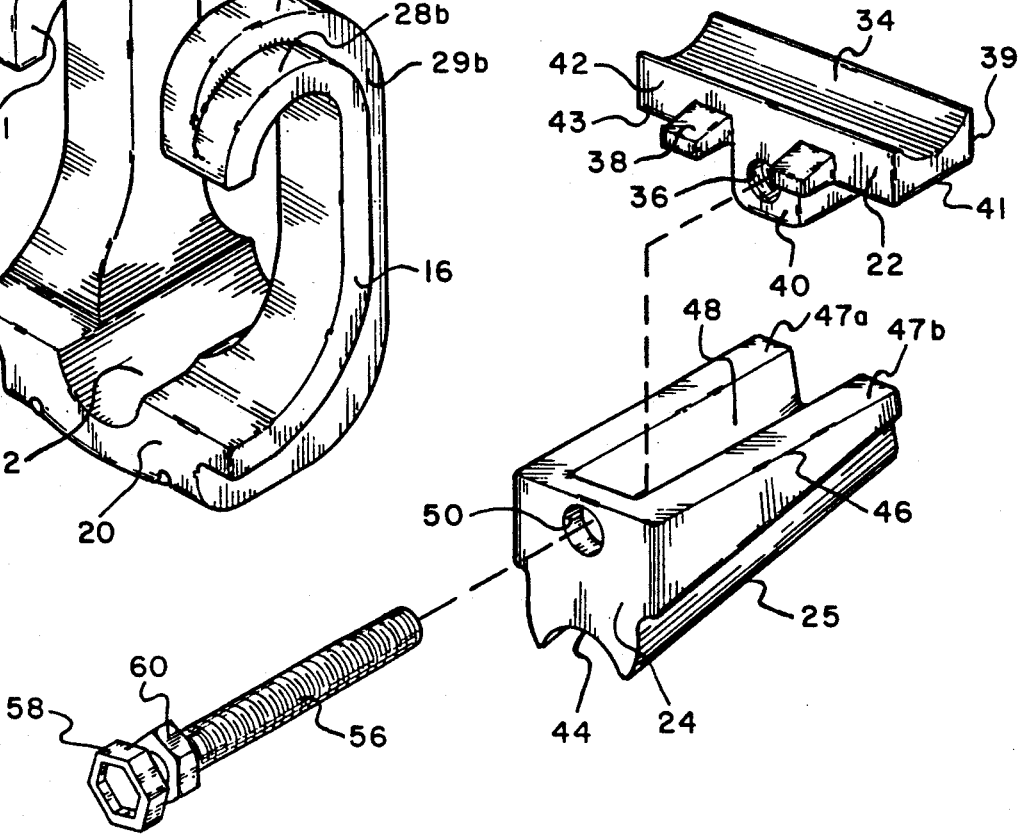
FIG. 7 is a perspective exploded view of the wedge assembly locking device and the adjusting bolt.

Referring now to FIG. 3 and FIG. 7, it can be seen that the wedge member 24 has an upper incline 46 relative to its lower horizontal surface 25. The horizontal surface 25 is contoured at 44 down its lengthwise center to engage the second conductor 14 (FIG. 2). The width of the wedge member 24 is such that it fits loosely between the fingers 18*a* and 18*b* of the C-shaped body member 16 within the space 19. The incline surface 46 is machined down its center on a horizontal plane through the shorter side 54 of the incline 46 up to but not through the taller side wall 52, shown in FIG. 3, and down to but not through the contoured surface on the horizontal plane leaving inclined ramps 47*a* and 47*b* on both sides. The machined area 48 is such that it is wide enough to freely fit the vertical section 40 (FIG. 4) of the T-shaped member 22 so that the vertical section 40 acts as a guide for the T-shaped member 22 and the underside 43 of the horizontal section 42 (FIG. 7) of the T-shaped member 22 slides freely and flatly along the incline 46. The height of the taller side 52 and shorter side 54 and the resulting incline 46 are such that the T-shaped member 22 can engage the first conductor 12 and the wedge-shaped member 24 can engage the second conductor 14 as the wedge assembly 26 effectively locks into position by tightening the adjusting bolt 56.

The member 22 is substantially T-shaped and has a horizontal section 42 significantly wider than the machined out area 48 of the wedge-shaped member 24. The top 34 of the T-shaped member 22 is contoured to engage the first conductor 12 in opposition to the inner surface 30 of the hooks 31. The width 41 and height 39 of the horizontal section 42 of the T-shaped member 22 are dictated by the size of the first conductor 12 and the establishment of a secure fit upon full engagement of the wedge assembly 26. The vertical section 40 is such that it slides freely within the machined out portion 48 of the wedge section 26 and the entire T-shaped member 22 slides freely and flatly along the incline 46.

Referring still to FIG. 7, the vertical section 40 of the T-shaped member 22 also has a hole 36 threaded perpendicularly therethrough and centered on the vertical section 40 such that, when the wedge assembly 26 is assembled, the hole lines up with a clearance hole 50 drilled through the higher end wall 52 of the wedge member 24. In assembled form, the higher end wall 52 is machined parallel to the vertical section surface 37, see FIG. 3, of the T-shaped member 22 through which the threaded hole is tapped. The holes are located to provide for free sliding of the T-shaped member 22 which requires flat and total contact with the incline 46. The T-shaped member also has four tabs such as shown at 38 located evenly with and on the same plane with the bottom surface 43 of the T-shaped member 22, on both sides of the vertical section 40 and on both sides of the horizontal section 42 to facilitate increased electrical contact.

Figure 4:
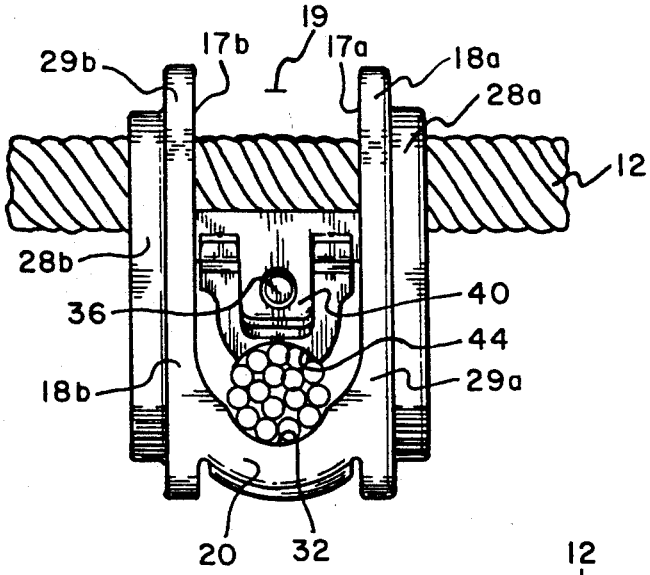
FIG. 4 is a cross-sectional view taken along the line 4—4 of FIG. 2.

Referring now to FIGS. 4 and 6 for further detail of the C-shaped body member 16, the body has flanges 28*a* and 28*b* protruding from the outside edges of the fingers 18*a* and 18*b* respectively to facilitate greater surface contact with the first conductor 12. The fingers also have reinforcing rims 29*a* and 29*b*, see FIGS. 2 and 6, spanning the outer edge of each finger 18*a* and 18*b*. The reinforcing rims extend significantly out from the outer surface of the flanges 28*a* and 28*b* to allow for the increased strength to withstand forces existing with the wedge assembly 26 installed.

Figure 5:
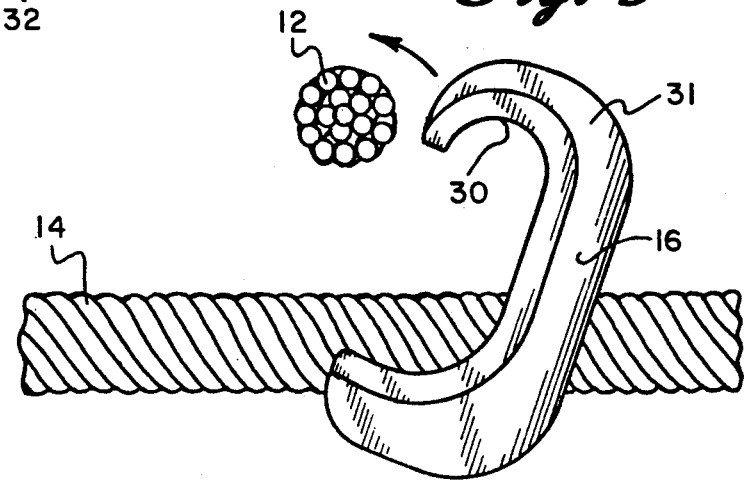
FIG. 5 is a side-view of the body of the connector and the procedure for installing the body member onto the transversing conductors.

The yoke section 20 of the body member 16 is contoured at 32 to engage the second conductor 14 along the surface, heading into the mouth of the "C", FIG. 5, or alternatively, heading between the parallel inside walls 17*a* and 17*b*, FIG. 4, of the fingers 18*a* and 18*b*. The space 19 between the fingers is wide enough to freely fit the wedge member 24 but narrower than the length of the horizontal section 42 of the T-shaped member 22. The space allows for movement of the wedge member 24 between the fingers 18*a* and 18*b* relative to the T-shaped member 22 until the wedge assembly 26 establishes the secure and rigid position shown in FIGS. 2 and 3.

Figure 5A:
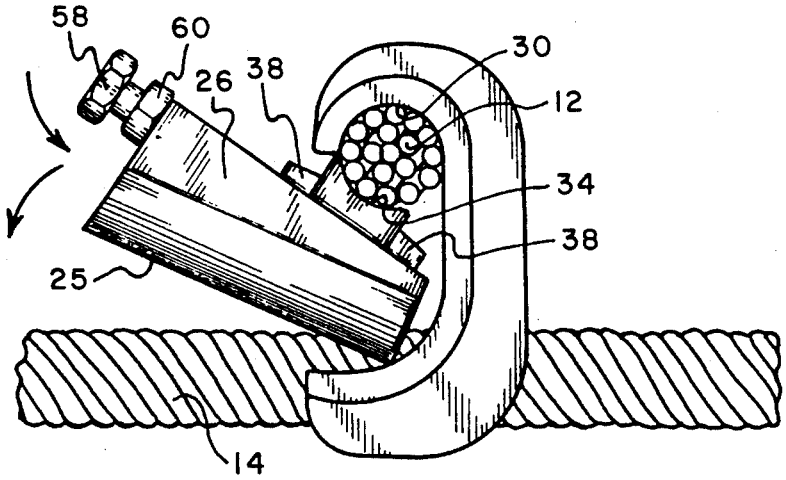
FIG. 5*a* is a side-view of the procedure for installing the wedge assembly between the transversing conductors after the body member is installed.

A simple procedure for installing the connector 10 will now be described. First, the C-shaped body 16 is placed upright on conductor 14 such that the contoured surface 32 of the yoke section 20 engages the conductor as shown in FIGS. 5*a* and 5. Referring to FIG. 5, the C-shaped body 16 and its hooks 31 are pulled over the first conductor 12 or the first conductor 12 is pushed down under, and into the contoured inner surface 30 of the hooks 31 so that each conductor is in place, as shown in FIG. 5*a*, and ready for installation of the wedge assembly 26. As shown in FIG. 5*a*, the wedge assembly 26 is then placed between the conductors 12 and 14. The wedge assembly 26 should enter the open area 19 between the fingers 18*a* and 18*b* at approximately 45 degrees to the upright C-shaped body member 16 as shown in FIG. 5*a*. Referring now to FIGS. 5*a* and 7, the T-shaped member's contoured surface 34 engages the first conductor 12 while the wedge shaped member's contoured surface 44, see FIG. 2, begins engagement with the second conductor 14. The wedge shaped member 26 is pushed down so that its contoured surface 44 fully engages the conductor 12 as shown in FIGS. 2 and 3.

Referring to FIG. 3, the bolt 56 is now turned clockwise starting the relative motion between the wedge member 24 and the T-shaped member 22. As the bolt 56 is tightened, the T-shaped member 22 further engages moving upward along the incline 46 and into the first conductor 12. As the T-shaped member's contoured surface 34 becomes steadily locked into place, the wedge shaped member 24 is drawn toward the now substantially fixed T-shaped member 22. As the incline 46 moves under the T-shaped member's bottom surface 43, the T-shaped member 22 is pushed further up and into the first conductor 12, and the contoured surface 44 on the horizontal plane 25, see FIGS. 2 and 7, of the wedge member 24 is pushed down and into the second conductor 14. Such relative motion continues until the wedge assembly 26 becomes rigidly locked between the conductors and effective separation is established, as shown in FIGS. 2 and 3. The adjusting bolt 56 is then turned further until the maximum torque and the resulting required separating force is reached as indicated by the breakaway hexagonal head 58 shearing off. The result is a secure and rigid electrical and mechanical connection between two transversing conductors. If ever needed, the connector 10 can be disassembled by loosening bolt 56 through the use of the second, fixed head 60.

The present invention may be embodied in other specific forms without departing from the spirit or essential attributes thereof and accordingly reference should be made to the appended claims rather than to the foregoing specification as indicating the scope of the invention.

What is claimed is:

1. In a connector for joining first and second crossing conductors extending substantially perpendicular to each other, said connector having a substantially C-shaped body member with openly spaced parallel fingers, said fingers being open at the free ends thereof and being joined by a yoke at the opposite end thereof, the inner surface of said fingers being contoured to engage said first conductor extending through the connector across the contoured inner surface of said fingers wherein the improvement comprises:

(a) said yoke of said C-shaped body member being contoured to engage said second conductor so that said second conductor is separated and spaced from said first conductor, said yoke and fingers being formed so that said second conductor can pass entirely through said connector with said second conductor extending substantially perpendicular to said first conductor, and (b) means for imposing a separating force between and against opposed surfaces of said first and second conductors.

2. The invention according to claim 1 wherein said yoke has a contoured surface on a length of an area which faces said open end and lies between said fingers.

3. The invention according to claim 1 wherein said imposing means comprises a locking device unconnected to said C-shaped body.

4. The invention according to claim 3 wherein said locking device comprises two members, each member independently engaging one of the two said conductors on a contoured surface, said locking device being moved into a secure position by way of relative motion between said members and engagement of said conductors with said contoured surfaces.

5. The invention according to claim 4 wherein said members comprise a wedge-shaped member and a T-shaped member connected by a bolt.

6. The invention according to claim 5 wherein said wedge-shaped member has a horizontal surface contoured to engage said second conductor.

7. The invention according to claim 6 wherein said wedge-shaped member has an inclined surface, relative to said horizontal surface, causing said wedge shaped member to have a high end and a low end, said inclined surface being machined to interact with said T-shaped member.

8. The invention according to claim 7 wherein said T-shaped member comprises a horizontal section and a vertical section, said vertical section being machined to interact with said machined inclined surface as a guide for said T-shaped member along said inclined surface.

9. The invention according to claim 8 wherein said horizontal section has an upper surface and a lower surface, said upper surface being contoured to engage said first conductor, said lower surface being flat to slide along said inclined surface.

10. The invention according to claim 9 wherein said bolt passes through said high end of said wedge-shaped member engaging said vertical section of said T-shaped member such that the said lower surface of said horizontal section of said T-shaped member slides freely and flatly along said inclined surface upon turning of said bolt.

11. The invention according to claim 10 wherein said locking device provides a separating force between said conductors in opposition to said contoured surfaces of said C-shaped body member until a rigid and secure position is established.

12. The invention according to claim 1 wherein said means for imposing a separating force is comprised of two members, each member independently engaging one of the two said conductors on a contoured surface thereof and a bolt passing freely through an aperture in one of said member and being threaded into an aperture in the other of said two members whereby turning of said bolt causes relative motion between said two members and engagement of said conductors with said contoured surfaces.

13. The invention according to claim 12 wherein at least one of said members is wedge-shaped.

* * * * *